United States Patent [19]

Azuma

[11] 4,050,191

[45] Sept. 27, 1977

[54] KNOCKDOWN APPARATUS FOR SUPPORTING AND DRIVING OVERHUNG DOORS

[75] Inventor: Akira Azuma, Uozu, Japan

[73] Assignee: Yoshida Kogyo K.K., Tokyo, Japan

[21] Appl. No.: 624,228

[22] Filed: Oct. 20, 1975

[30] Foreign Application Priority Data

Oct. 21, 1974 Japan ..... 49-127200[U]

[51] Int. Cl.[2] ..... E05F 15/14

[52] U.S. Cl. ..... 49/360; 49/118; 49/123

[58] Field of Search ..... 49/118, 123, 360

[56] References Cited

U.S. PATENT DOCUMENTS

| | | | |
|---|---|---|---|
| 1,966,182 | 7/1934 | McCormick | 49/123 |
| 3,172,651 | 3/1965 | Wilson | 49/360 |

FOREIGN PATENT DOCUMENTS

| | | | |
|---|---|---|---|
| 1,044,248 | 9/1966 | United Kingdom | 49/360 |

*Primary Examiner*—Kenneth Downey

*Attorney, Agent, or Firm*—Hill, Gross, Simpson, Van Santen, Steadman, Chiara & Simpson

[57] ABSTRACT

A drive assembly, driven assembly and track assembly are provided separately for ready installation on a doorframe to support and drive a pair of overhung doors. The drive assembly comprises a pulley and its drive mechanism which are mounted on a common bracket to be fastened to one of the jambs of the doorframe, whereas the driven assembly includes an idler pulley mounted on another bracket to be fastened to the other jamb. The track assembly comprises a rail bolted at both ends to the two brackets, and two pairs of door hangers in rolling engagement with the rail for suspending the respective doors therefrom. The door hangers are attached to an endless wire rope extending around the pulleys.

3 Claims, 4 Drawing Figures

KNOCKDOWN APPARATUS FOR SUPPORTING AND DRIVING OVERHUNG DOORS

BACKGROUND OF THE INVENTION

1. Field of Invention

This invention relates generally to door hardware, and more specifically to knockdown apparatus for supporting or suspending a door or doors from above and for driving them between closed and opened positions.

2. Prior Art

Conventional apparatus for supporting and driving overhung doors of the class and kind herein under consideration has been more or less of unitary construction, such that a motor, speed reducer, drive and idler pulleys, rail and so forth are mounted in predetermined relative positions on a common support structure. This support structure is intended to be installed on a transom or the like of a desired doorframe to suspend doors therefrom. Since the longitudinal dimension of such conventional apparatus is predetermined, however, it can be installed on a doorframe of a specified horizontal length only and is not adaptable for use on doorframes of other than the specified length.

Another objection to the noted conventional apparatus relates to its great bulk and weight, which also results from the unified arrangement of all its components. A considerable number of workers must cooperate for installation of the apparatus in an elevated position on a doorframe with the aid of such insecure footings as stools or ladders. Moreover, in the event of trouble in some part of the apparatus, the entire apparatus may have to be removed for repair or readjustment, no matter how minor the trouble may be.

SUMMARY OF THE INVENTION

It is an object of this invention to provide knockdown or modular apparatus for ready installation in, or removal from, its working position on a doorframe to support and drive a suspended door or doors, such that the noted disadvantages of the prior art are thoroughly overcome.

Another object of the invention is to provide apparatus of the character described which easily adapts itself to doorframes, the horizontal length of which is shorter than the longitudinal dimension of the apparatus.

With these and other objects in view, this invention provides knockdown apparatus broadly comprising a drive assembly, driven assembly and track assembly which can be removably connected to each other in their predetermined relative positions. The drive and driven assemblies, moreover, can be removably mounted in desired positions on a doorframe.

More specifically, the drive assembly comprises a drive wheel such as a pulley and its drive mechanism which are both mounted on a first bracket to be removably fastened to one of the side jambs of the doorframe. The driven assembly includes an idler wheel mounted on a second bracket to be removably fastened to the other side jamb. The idler wheel is driven from the drive wheel via an endless wire rope or like flexible member. The track assembly comprises a rail removably fastened at both ends to the first and second brackets to provide an overhead track for a door or doors, and at least a pair of door hangers in rolling engagement with the rail to suspend the door therefrom. These door hangers are attached to the endless, flexible member operating over the two wheels.

Thus, for repair or readjustment of some component of the apparatus, only that assembly be removed to which the component belongs. It will also be appreciated that the knockdown apparatus according to the invention is adaptable for use on a doorframe, the horizontal length of which is shorter than the longitudinal dimension of the apparatus, merely by severing the rail of the track assembly to a shorter length.

The features which are believed to be characteristic of this invention are set forth in particular in the appended claims. The invention itself, however, both as to its organization and mode of operation, together with the further objects and advantages thereof, will be apparent from the following description of a preferred embodiment, which is to be read in connection with the accompanying drawings in which like reference characters denote corresponding parts of the several views.

DESCRIPTION OF THE PREFERRED EMBODIMENT

Figure 1:
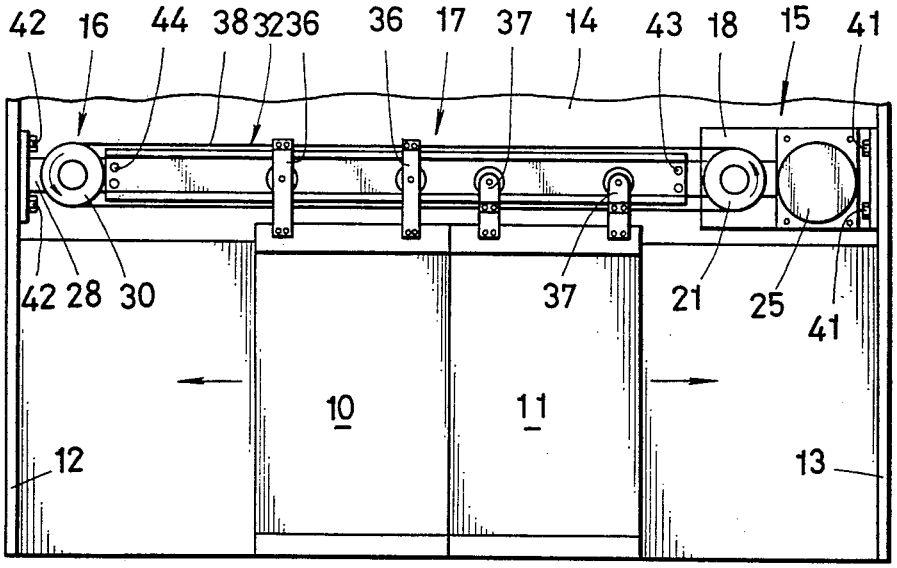
FIG. 1 is a front elevational view of the knockdown apparatus constructed in accordance with the novel concepts of this invention, the apparatus being shown installed in position on a doorframe to support and drive a pair of overhung doors.

In FIG. 1 the apparatus according to this invention is shown adapted for use with a pair of overhung doors 10 and 11 which are movable toward and away from each other within a doorframe comprising a pair of opposed side jambs 12 and 13 and a transom 14. The illustrated apparatus broadly comprises a drive assembly 15 removably mounted on the side jamb 13, a driven assembly 16 removably mounted on the other side jamb 12, and a track assembly 17 removably supported between the drive and driven assemblies 15 and 16.

Figure 2:
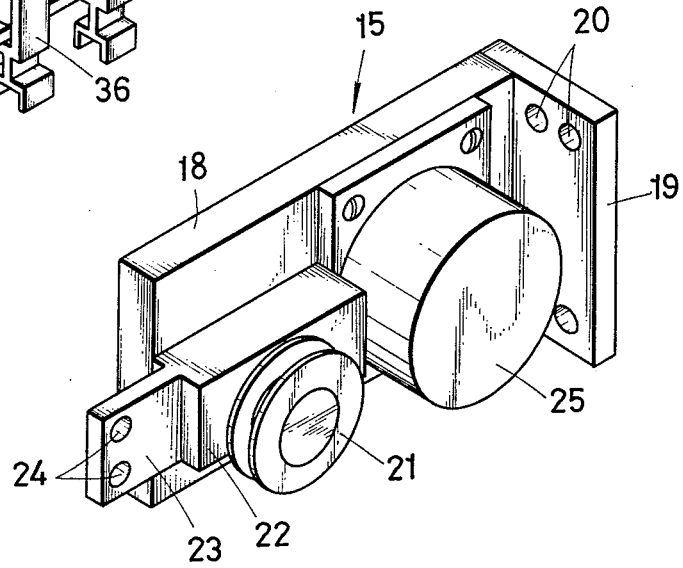
FIG. 2 is an enlarged perspective view of the drive assembly used in the apparatus of FIG. 1.

As illustrated in greater detail in FIG. 2, the drive assembly 15 includes a bracket 18 having a mounting plate or flange 19 at one end in right-angular relationship thereto. The mounting plate 19 has several holes 20 therethrough for the insertion of bolts or like fasteners, so that the bracket 18 can be bolted or otherwise removably fastened to the side jamb 13 via the mounting plate.

The drive assembly 15 further includes a drive pulley 21 rotatably and removably mounted on a thickened portion 22 formed on the exterior face of the bracket 18, that is, on that face of the bracket which is directed away from the transom 14. The thickened portion 22 has a tongue 23 projecting therefrom in a direction away from the mounting plate 19, and this tongue has holes 24 therethrough for purposes later described.

Also included in the drive assembly 15 is a drive mechanism for imparting rotation to the drive pulley 21. The drive mechanism comprises a reversible electric motor 25 removably mounted on the exterior face of the bracket 18, and a speed reduction device, not shown, on the interior face of the bracket.

Although not seen in the drawing, the drive shaft of the motor 25 is coupled in driving relationship to the unshown speed reduction device when the motor is mounted on the bracket 18, and the drive pulley 21 is mounted on the output shaft of the speed reduction device which extends through, and is rotatably journalled in, the thickened portion 22 of the bracket.

Figure 3:
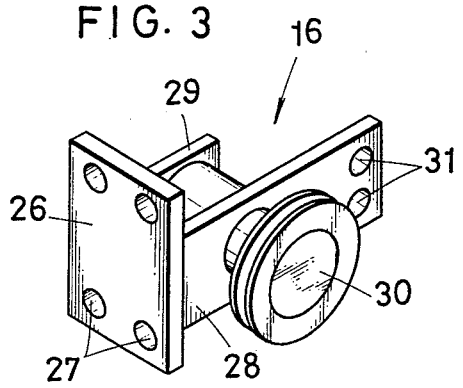
FIG. 3 is an enlarged perspective view of the driven assembly used in the apparatus of FIG. 1.

FIG. 3 illustrates the details of the driven assembly 16. This assembly includes a mounting plate 26 having holes 27 therethrough for the insertion of bolts or like fasteners for use in removably mounting the driven assembly on the side jamb 12 of the doorframe. A pair of brackets 28 and 29 project from the mounting plate 26 in parallel spaced relationship, and an idler pulley 30 is rotatably and removably supported on these brackets. The bracket 28 is longer than the other bracket 29, and the bracket 28 has holes 31 at its front end for purposes later described.

Figure 4:
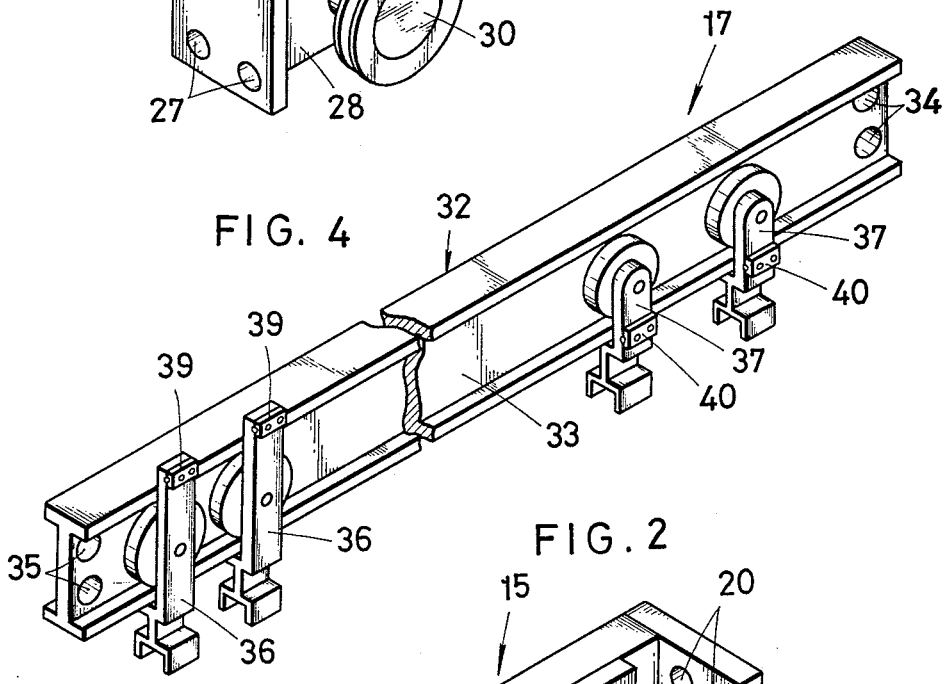
FIG. 4 is an enlarged perspective view, partly broken away, of the track assembly also used in the apparatus of FIG. 1.

With reference to FIG. 4, the track assembly 17 includes an I-rail 32 of an aluminum-base alloy or like material which is supported between the drive and driven assemblies 15 and 16 to provide an overhead track for the doors 10 and 11. The I-rail 32 includes a web 33 connecting its top and bottom flanges, and this web has holes 34 and 35 at both ends. The holes 34 are aligned with the respective holes 24 in the tongue 23 of the drive assembly 15 for receiving bolts or the like in removably fastening the rail 32 to the bracket 18. The holes 35, on the other hand, are aligned with the respective holes 31 in the bracket 28 of the driven assembly 16 for receiving bolts or the like in removably fastening the rail 32 to the bracket 28.

The track assembly 17 further includes a pair of door hangers 36 for suspending the door 10 from the I-rail 32, and another pair of door hangers 37 for suspending the door 11 from the rail. The doors 10 and 11 can be removably attached to the respective pairs of door hangers 36 and 37 in a well known manner. The door hangers 36 and 37 include rollers arranged for rolling engagement with the bottom flange of the I-rail 32.

As shown in FIG. 1, the pair of door hangers 36 are secured, with a suitable spacing therebetween, to the upper flight of an endless wire rope 38 or the like extending around the drive and idler pulleys 21 and 30. A retainer 39 shown in FIG. 4 is for use in screwing or clamping each door hanger 36 to the wire rope 38. The other pair of door hangers 37 is likewise secured to the lower flight of the wire rope 38 with the aid of a pair of retainers 40.

For installation and assemblage of the knockdown apparatus of the foregoing construction, the drive assembly 15 may first be fastened to the side jamb 13 by the bolts or the like inserted through the holes 20 in the mounting plate 19, the bolts being shown at 41 in FIG. 1. The driven assembly 16 is similarly fastened to the other side jamb 12 by the bolts 42 or the like inserted through the holes 27 in the mounting plate 26.

With the drive and driven assemblies 15 and 16 thus mounted in position on the doorframe in opposed relationship to each other, the I-rail 32 of the track assembly 17 may then be connected to the brackets 18 and 28 by the bolts 43 or the like inserted through the holes 24 and 34 and by the bolts 44 or the like inserted through the holes 31 and 35. The doors 10 and 11 can then be suspended from the rail 32 by the respective pairs of door hangers 36 and 37.

The foregoing procedure can be reversed for removal and disassembly of the apparatus. It will be evident from a consideration of FIG. 1 that the doors 10 and 11 open or move away from each other when the motor 25 is activated to cause rotation of the drive and idler pulleys 21 and 30 in the arrow marked direction, and that the doors close or move toward each other when the pulleys are rotated in the opposite direction.

While the apparatus according to this invention has been shown and described hereinbefore in terms of its preferred form, it is understood that the invention itself is not to be restricted to the exact construction details disclosed. For example, the endless wire rope 38 extending around the drive and idler pulleys 21 and 30 is replaceable by an endless chain or other suitable endless, flexible members, and the pulleys may also be replaced by sprockets or other wheels.

Thus, a latitude of modification, substitution or change is intended in the foregoing disclosure, so that the invention should be construed broadly and in a manner consistent with the spirit and scope of the following claims.

What is claimed is:

1. A door support apparatus for installation between a pair of side jambs of a doorframe to support and drive a suspended door, said apparatus comprising, in combination:

a. a drive assembly comprising,
   1. a first bracket adapted to be removably fastened to one of said side jambs;
   2. a drive wheel rotatably mounted on said first bracket; and
   3. a drive mechanism mounted on said first bracket and drivably connected to impart rotation to said drive wheel;

b. a driven assembly comprising,
   1. a second bracket adapted to be removably fastened to the other of said side jambs; and
   2. an idler wheel rotatably mounted on said second bracket;

c. An endless flexible member interconnecting said wheels; and d. a track assembly comprising,
   2. a rail removably fastened at both ends to and supported by said first and second brackets to provide an overhead track for the door; and
   2. at least a pair of door hangers in rolling engagement with said rail and adapted to suspend the door therefrom, said door hangers being attached to said endless, flexible member for moving the door along said track.

2. A door-support apparatus as claimed in claim 1, wherein each of said first and second brackets includes a mounting plate having holes therethrough for insertion of fasteners for use in removably fastening said brackets to the vertical side jambs.

3. A door-support apparatus as claimed in claim 1, wherein each of said first and second brackets includes a portion having holes therethrough for reception of fasteners by which said brackets are detachably secured to said rail, said rail including a web having holes therethrough receiving such fasteners.

* * * * *